United States Patent [19]

Gonzales

[11] 3,987,513

[45] Oct. 26, 1976

[54] MOP WRINGER

[76] Inventor: Charles M. Gonzales, Rte. 1, Box 110, Arvin, Calif. 93203

[22] Filed: Dec. 18, 1975

[21] Appl. No.: 642,073

[52] U.S. Cl. ..... 15/262
[51] Int. Cl.[2] ..... A47L 13/60
[58] Field of Search ..... 15/262; 100/176

[56] References Cited

UNITED STATES PATENTS

| | | | |
|---|---|---|---|
| 1,803,297 | 4/1931 | Schneider | 15/262 |
| 2,615,191 | 10/1952 | Brown | 15/262 |

*Primary Examiner*—Edward L. Roberts

[57] ABSTRACT

An electrically operated wringer for a conventional floor mop has a two step switch operated by movement of a hinged section of trough on which a wet mop is laid. At the first step of the switch a circuit is closed starting a motor for the wringing rolls. At the second step a relay is actuated causing the motor to reverse the direction of the rolls and back the mop out of the trough. When the mop is lifted clear, the switch opens and breaks the circuit.

7 Claims, 5 Drawing Figures

MOP WRINGER

Conventional wet mop wringers commonly operate much like a clothes wringer in that when the water laden wet mop is to be wrung out, wringer rolls are cranked by hand. The water wrung from the mop usually is caught in a bucket.

Maintenance operations for large commercial buildings frequently entail the mopping of smooth-surfaced floors which extend over vast areas, frequently requiring the work of a crew of men capable of mopping the entire area in a relatively short time without tying up traffic.

For floors to be mopped clean the mop needs to be washed and wrung out with a reasonable degree of frequency. In mopping operations there are times when the first mopping may be a relatively wet mopping, and the first mopping then followed by a relatively dry mopping capable of taking up most of the moisture left by the initial mopping. Virtually all of these operations require frequent rinsing and wringing out of the mop either to a partially wet condition or to a relatively dry condition. A great deal of time, consequently, is spent wringing out the mop, which could be more advantageously spent in the mop up operation.

It is therefore among the objects of the invention to provide a new and improved automatic mop wringer which avoids the need for manual cranking and which operated relatively rapidly and effectively.

Another object of the invention is to provide a new and improved automatic mop wringer, the operation of which is commenced by application of the mop to the wringing apparatus and which automatically discontinues operation when the mop is removed.

Still another object of the invention is to provide a new and improved automatic mop wringing device which initially operates in one direction to squeeze out an initial amount of water and then automatically reverses thereby to more thoroughly dry the mop before it is removed.

Still another object of the invention is to provide a new and improved automatic mop wringer which has an alternate manual control, such that by manual operation the operator can carefully adjust the wetness or dryness of the mop during the otherwise automatic mop wringing operation.

Further included among the objects of the invention is to provide a new and improved automatic electrically actuated mop wringer which performs the mop wringing operation effectively and with a considerable amount of rapidity whereby to greatly improve the available time of the operator for performing the actual mopping operation.

With these and other objects in view, the invention consists in the construction, arrangement, and combination of the various parts of the device, whereby the objects contemplated are attained as hereinafter set forth, pointed out in the appended claims, and illustrated in the accompanying drawings. In the drawings:

Figure 1:
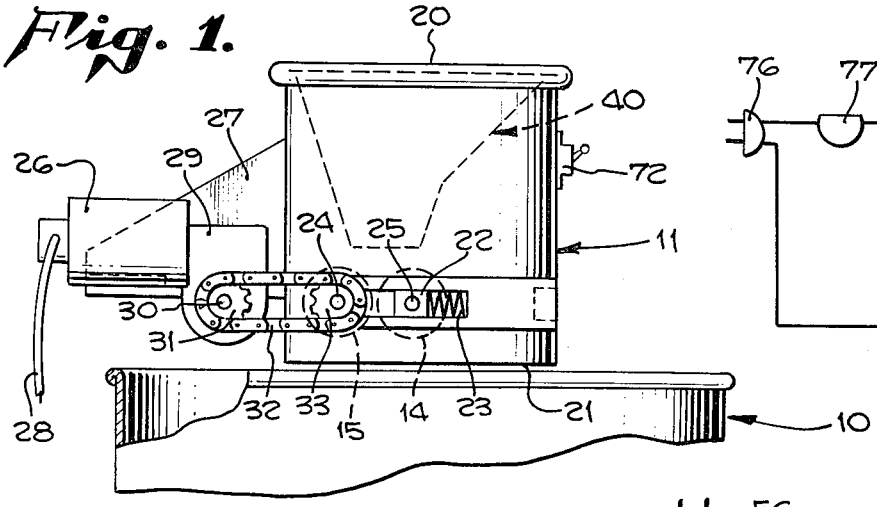
FIG. 1 is a side elevational view of a bucket for mop rinse water on the top of which is mounted the automatic mop wringing device.
Figure 5:
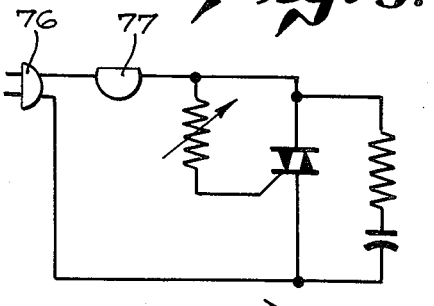
FIG. 5 is a wiring diagram of a converter circuit.

In an embodiment of the invention chosen for the purpose of illustration, there is shown a bucket 10 which is used to contain wash water for a mopping operation. On top of the bucket is a hopper 11 relatively smaller than the bucket 10 in cross-sectional shape and mounted on the top of the bucket so that a mop 12 fastened in a conventional manner on the bottom of the mop handle 13 is dipped and rinsed in the contents of the bucket when need be. For wringing out the water laden mop 12 use is made of a pair of counterrotating wringer rollers 14 and 15, the roller 14 being a driven roller and the roller 15 being an idler roller. The rollers are journaled in suitable bearings on the wall of the hopper 11. As clearly shown the hopper 11 has an open top 20 and an open bottom 21 so that water which is wrung from the mop falls back into the bucket 10.

Figure 2:
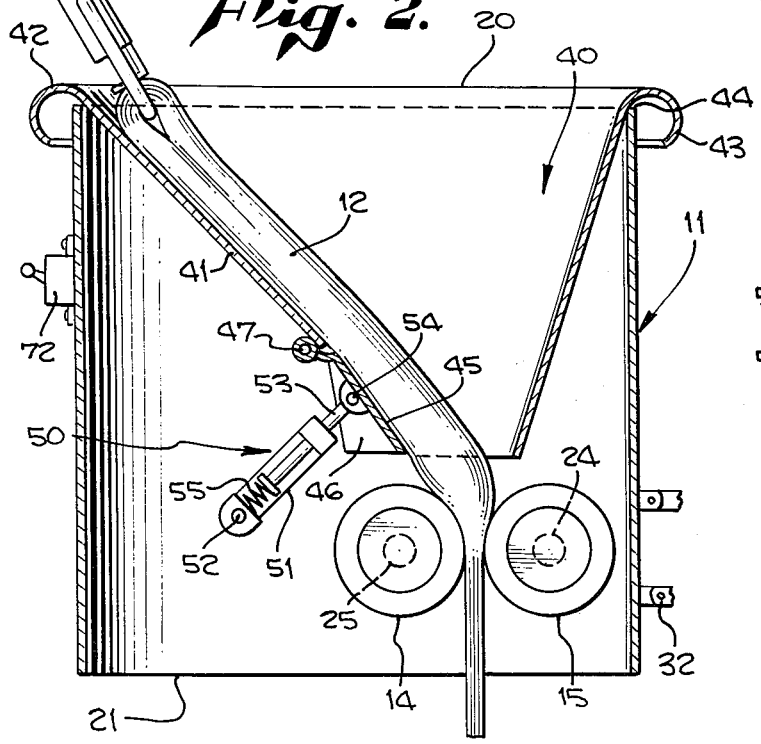
FIG. 2 is a longitudinal sectional view.

As noted in FIG. 2, the rollers 14 and 15 are in parallel spaced relationship and retained in a selected spaced apart position by action of an idler roll bridge 22. The idler roll bridge 22 includes a spring 23 so that the idler roller 15 is able to yield if the mop is thicker than usual, while at the same time permitting the mop to be passed between the rollers. The idler roll bridge is engaged at one end with a shaft 24 of the driven roller 14 and at the other end with a shaft 25 of the idler roller 15.

For operating the driven roller 14 there is provided an electric motor 26 mounted on a bracket 27 which is supported by the hopper 11, with the motor being supplied by an electric lead 28 from an appropriate source of power. Action of the motor 26 travels through a gear reducer 29 to step down the speed of rotation of a motor drive shaft 30 on which is mounted a sprocket 31. Extending around the sprocket is a drive chain 32 which transfers rotation of the motor drive shaft 30 and sprocket 31 to a sprocket 33 secured to the shaft 24 of the driven roller 14.

In the hopper 11 is a trough indicated generally by the reference character 40, a wall portion of which is sloped for reception of the mop 12. The trough is provided with loops 42 and 43 so that it can be suspended from a top edge 44 of the hopper 11. In the embodiment of the illustration there is a cutout section 45 of the wall portion 41 which acts as a panel, reinforced by means of a rib 46. A hinge 47 connects the panel to the wall portion so that the panel is free to swing. For initiating operation of the motor by mop pressure, there is provided a multiple step switch assembly 50, physical details of which are shown in FIG. 2. The switch includes a housing 51 pivotally secured to the hopper 11 by means of a pivot pin 52. An armature 53 which reciprocates in the housing 51 has its outer or free end pivotally attached by means of a pivot 54 to the panel 45. By action of a spring 55 acting through the armature 53 the panel 45 is normally biased in an oblique direction upwardly into the trough 40 so that it can be readily depressed by a water laden mop 12. Once the mop has had the water wrung from it, or on the other hand has been removed entirely from the trough 40, the spring 55 returning the panel 45 obliquely upwardly also causes a disconnection of power to the motor.

Figure 3:
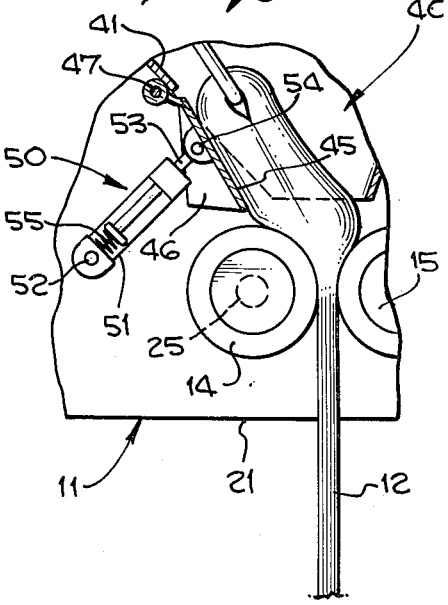
FIG. 3 is a fragmentary longitudinal sectional view similar to FIG. 2 but with the mop in a lower position.

For an explanation of the automatic operation of the wringer roll, reference is made to the wiring diagram of FIG. 3.

As shown in the diagram, there is provided a conventional plug 56 which is used to plug into a source of electric power which is customary 110 to 120 volts AC power. In this embodiment leads 57 and 58 are connected to a conventional rectifier 59. Another lead 60 is grounded. This is equipment employed when the motor 20 is a direct current motor. Other electrical circuitry of substantial conventional sort can be resorted to when the motor is an AC motor.

From the rectifier 59 a lead 61 interconnects with a first step 62 of the multiple step switch assembly 50. From the first step 62 a lead 62 attaches to one end 64 of the motor 26. From the rectifier 59 another lead 65 connects directly with the other end 66 of the motor.

Interconnected as described when the first step 62 of the multiple step switch is closed, the motor starts operating in a forward direction turning the driven roller clockwise as viewed in FIG. 2. The clockwise action acting upon and through the mop 12 causes the idler roller 15 to rotate in a counterclockwise direction. As the two rollers counterrotate toward each other, the mop 12 is squeezed between them, and liquid is forced out. In the chosen form the weight of the water laden mop 12, when laid on top of the panel 45, moves the armature 53 to a first step position at which point the first step 62 is closed. This is what starts operation of the rollers.

Figure 4:
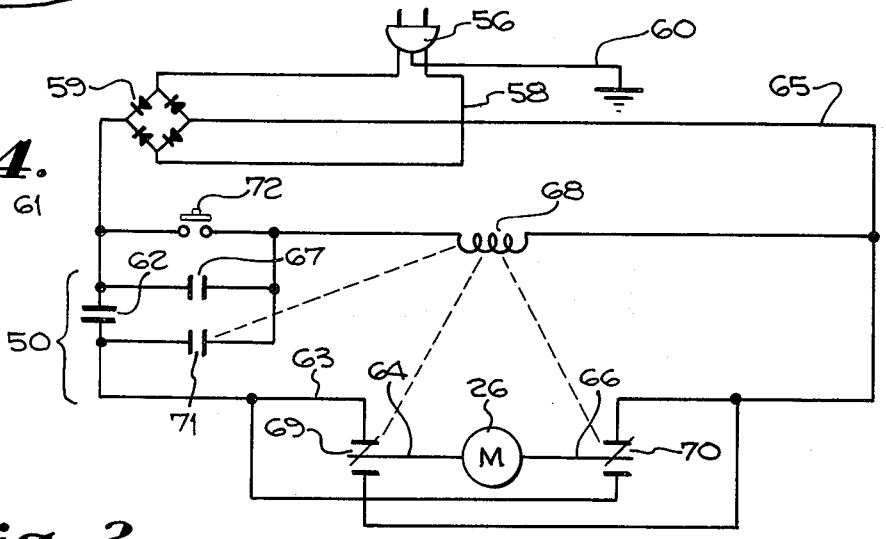
FIG. 4 is a wiring diagram of the electrical control of the mop wringing device.

As the mop reaches the bottom of the trough 40 and the upper end of the mop is pulled, with the handle, to a position overlying the panel 45, the armature 53 is depressed still further to close a second step 67 of the multiple position step switch assembly. Closing the second step 67 energizes a primary relay 68. Energization of the primary relay reverses the position of plates 69 at the left end of the motor, as viewed in FIG. 4, as well as the plates 70 at the right end of the motor, thus reversing the flow of current through the motor. Inasmuch as this chosen motor is a DC motor, reversal of the current will cause a reversal in rotation of the motor drive shaft and, in consequence, a reversal of rotation of the driven roller 14 and idler roller 15.

At the same time that the primary relay 68 is energized it will activate a set of plates 71 to electrically lock on the circuit, independently of action of the second step 67.

As rotation of the counterrotating rollers 14 and 15 takes place, the mop is moved upwardly until it is moved clear of contact with the rollers. At this point the mop is cleared for withdrawal, and upon withdrawal the spring 55 becomes operative to shift the armature 53 obliquely upwardly until the first step 62 of the multiple step switch is opened again. Opening the switch breaks contact with the primary relay 68, and all of the steps of contact are returned to initial position ready for a second operation to take place.

If desired, in order to change the wetness of the mop, after motor operation has been started in the manner described, drawing the mop downwardly while wringing out the liquid contents, by manipulation of a manually actuated switch 72 reverse rotation of the rollers can be started before the mop 12 is pulled entirely through the rollers. This leaves the mop in partially wet condition. Upon completion of reverse rotation of the rollers, the mop can be withdrawn for use. If desired, however, the mop can be permitted to lie on the panel 45 in which event forward rotation is again started, for the rollers, and can again be reversed at will by manipulation of the manually actuated switch 72. A considerable degree of versatility in mop wringing in this fashion is built into the device, which remains all automatic except for manipulation of the manually actuated switch. Clearly, of course, the manually actuated switch 72 can be a foot operated switch mounted as might be elected on either the bucket 10 or the hopper 11.

On those occasions where the premises to be mopped chance to have power supplied at 220 volts, there may be provided a transformer 75 and a plug 76 for the source of electric power and socket 77 for reception of the plug 56 of the automatic wringer device. The transformer 75 may be any one of an acceptable conventional type of transformer capable of converting a voltage of 220 volts to one of about 110 volts.

Having described the invention, what is claimed as new in support of Letters Patent is as follows:

1. An automatic electric operated mop wringer for a conventional wet mop comprising a trough structure having top and bottom openings and at least one sloping side wall, a pair of counterrotating wringer rollers in spaced parallel relationship below said bottom opening, a forward and reverse acting electric motor means and a drive therefrom to the rollers, a panel at said side wall having a pivotal mounting on said trough structure and spring biased into said trough, a multiple step electric switch having an armature normally spring biased to open position and attached to and adapted to be closed by action of said panel upon engagement with successive portions of the mop, an electric circuit including a primary branch interconnecting said motor in a forward direction and a first step of said multiple step switch, a secondary branch of said electric circuit interconnecting said motor in a reverse direction and a second step of said multiple step switch, primary relay means in said circuit subject to actuation by said second step adapted to energize said secondary branch and reverse the action of the motor until engagement of the mop on said panel is relieved to an amount effecting return of said panel to initial position and return of said switch to open position.

2. An automatic electric operated mop wringer as in claim 1 wherein said panel is a section of the trough and pivotally connected to the trough.

3. An automatic electric operated mop wringer as in claim 2 wherein one movable part of said multiple step switch is connected to said section and another part of said switch is connected to said trough.

4. An automatic electric operated mop wringer as in claim 1 wherein the trough is mounted in a housing and said rollers are carried by said housing.

5. An automatic electric operated mop wringer as in claim 4 wherein one of said rollers is a drive roll connected to the motor and the other roll is an idler roller, there being a yieldable bridge interconnecting said rollers.

6. An automatic electric operated mop wringer as in claim 1 wherein said primary relay means is connected in series with said second step of the multiple switch and wherein there is a first set of relay contacts at one of two motor connections, a second set of relay contacts at the other of two motor connections and a third set of relay contacts in parallel with said second step of the multiple position switch.

7. An automatic electric operated mop wringer as in claim 6 wherein there is a manually actuated switch in parallel with respectively said second step of the multiple position switch and said third set of relay contacts.

* * * * *